United States Patent [19]

Bakhtiari

[11] Patent Number: 4,575,833

[45] Date of Patent: Mar. 11, 1986

[54] BAND MOUNTING FOR WRIST WATCH, AND ASSEMBLY, WITH IMPROVED VIEWING

[76] Inventor: Zilley H. Bakhtiari, 1777 Mitchell Ave., #8, Tustin, Calif. 92680

[21] Appl. No.: 658,700

[22] Filed: Oct. 9, 1984

[51] Int. Cl.[4] ..... G04B 37/00; G04C 23/02

[52] U.S. Cl. ..... 368/282; 368/88

[58] Field of Search ..... 368/281–282, 368/88, 276, 299–300, 309, 316–317; 224/164, 170, 179; D10/32, 38

[56] References Cited

U.S. PATENT DOCUMENTS

| | | | |
|---|---|---|---|
| 2,226,138 | 12/1940 | Prestinari | 368/281 |
| 4,006,587 | 2/1977 | Hugúenin | 368/281 |

FOREIGN PATENT DOCUMENTS

| | | | |
|---|---|---|---|
| 1523841 | 7/1969 | Fed. Rep. of Germany | 368/282 |
| 2014824 | 10/1970 | Fed. Rep. of Germany | 368/281 |
| 57-6380 | 1/1982 | Japan | 368/282 |
| 205957 | 7/1939 | Switzerland | 368/281 |

*Primary Examiner*—Vit W. Miska

*Attorney, Agent, or Firm*—Willie Krawitz

[57] ABSTRACT

A new and improved band mounting for a wrist watch case is provided for ease of viewing.

The band mounting enables a watch case to be elevated from the normal, flat position, and is worn adjacent to the inner wrist, both of these factors contributing to better viewing. In addition, the band is contoured to maintain the watch case relatively fixed on the wearer's wrist.

8 Claims, 5 Drawing Figures

BAND MOUNTING FOR WRIST WATCH, AND ASSEMBLY, WITH IMPROVED VIEWING

BACKGROUND OF THE INVENTION

This invention relates to a new and improved wrist watch, and more specifically, to a wrist watch case that can be oriented for improved viewing.

The 'standard' type of wrist watch case is worn on the flat portion of the wearer's wrist. However, the basic problem with such an orientation is that the wearer must usually rotate the wrist in order to read or view the watch.

Various types of wrist watch cases are well known, and typical patents in this field are U.S. Pat. Nos. D 224,913; D 228,939; D 231,662 and D 236,592. Some of these prior art patents disclose watch cases that are curved, to fit the wearer's wrist, but this is expensive, and could require a change in the location and design of component parts. In addition, one watch design inclines the watch face to the flat portion of the watch, but this represents an expensive departure from the 'standard' type of watch case. Moreover, none of these patents disclose how to provide a wrist watch case that may be worn comfortably while at the same time orienting the watch to permit reading by the wearer, with only a minor amount of wrist movement.

It would be preferred to employ a 'standard' watch casing that can be worn on the side of the wearer's wrist by means of a special band. In this manner the costs of wearing a watch case on the side of a wearer's wrist would be transferred to the watch band, and the cost of the watch case would remain unchanged.

THE INVENTION

According to the invention, there is provided a wrist watch and wrist band therefor which is shaped or configured to maintain the band in place on a portion of the wearer's wrist without significant movement. This feature enables orientation of the watch case on the side of the wearer's wrist. In addition, the watch case is elevated from its normal, flat position so that the plane of the watch face is oriented towards the wearer's view. If desired, the plane of the watch face could be about orthogonal to the wearer's eyes.

The combined effect of configuring the watch band to maintain the watch case without movement on the wearer's wrist, and elevation of the watch case, provide a greatly increased viewing capability, with less arm movement effort being required on the part of the wearer, as compared to present day watches.

DESCRIPTION OF THE PREFERRED EMBODIMENTS

Figure 1:
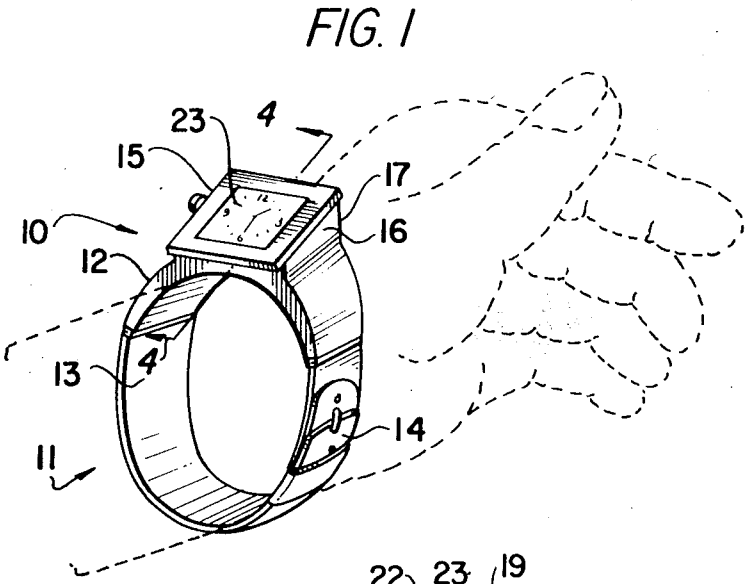
FIG. 1 is an external perspective view of the wrist watch of this invention mounted on a wearer's wrist.

The wrist watch casing assembly 10 of this invention is shown in FIG. 1, and includes a band element 11 having a fairly rigid configured portion 12 that is shaped to engage the inner side portion of a wearer's wrist. This configured portion 12 may be constructed of plastic, metal, leather, etc., and can be one of several sizes, if desired. The remainder 13 of the band element 11 is flexible, and may include a conventional strap and buckel 14, or a segmented bracelet, link chain, etc. A wrist watch casing 15 of conventional construction is inserted into an elevated mounting 16 on the configured portion 12 adjacent to the side portion 17 of the wearer's wrist. The mounting may be constructed of plastic, metal, leather, etc. The watch casing 15 can include a digital readout, an arm movement type, etc.

Figure 4:
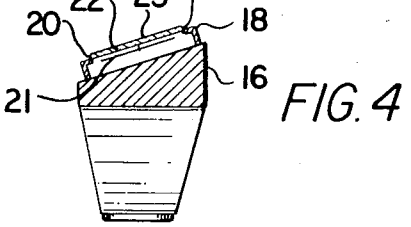
FIG. 4 is a cross sectional view in side elevation taken along lines 4—4 of FIG. 1; and, FIG. 5 is a cross sectional view in side elevation taken along lines 5—5 of FIG. 2.

As shown in FIG. 4, the elevated mounting 16 defines a cavity 18, the mounting having flexible sidewalls 19, 20 and 21, and an inclined base segment 22. Thus, when the watch casing 15 is mounted into the inclined cavity, the watch face 23 will be inclined upwardly towards the wearer's line of sight, and enables improved viewing over conventionally mounted watch casings. The inclination of the watch face 23 to the wearer's view may vary from about 5°–25° of the flat elevation on the wearer's wrist, and typical inclinations vary from about 10°–20°. Since the sidewalls are flexible, the watch casing can be simply press fitted into the cavity.

Figure 2:
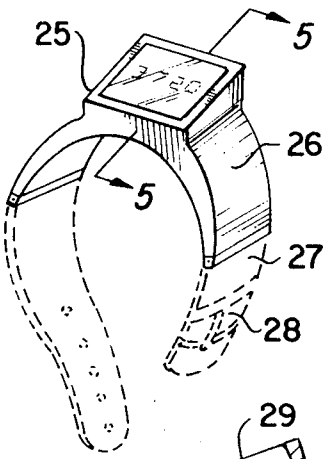
FIG. 2 is an external perspective view of a mounting for the wrist watch showing another embodiment of the invention.
Figure 5:
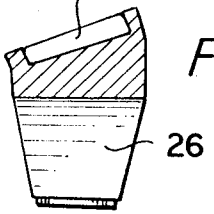

In FIG. 2, another embodiment of the invention is shown, in which the watch casing 25 is integrally molded into a configured saddle 26 that is attached to a band 27, which includes a strap and buckle 28. As shown in FIG. 5, an inclined mounting 29 is molded into the saddle 26, and the watch casing is press fitted, or bonded therein, or both.

Figure 3:
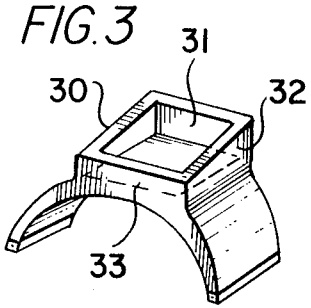
FIG. 3 is an external perspective view of another mounting for the wrist watch.

In FIG. 3, a mounting 30 in a wrist band is shown having a three-way tilt along inclined sidewalls 31, 32, 33 for elevating a watch casing which is press fitted therein. This arrangement enables a somewhat different view depending on the wearer's preference.

The assembly and watch band mounting of this invention enables a watch casing to be worn in an inclined manner to the wearer without requiring a change in the structure of the casing. When the band is worn out, the watch casing can be refitted easily into a band of this invention, or even into a conventional band setting.

I claim:

1. An assembly of a wrist watch casing and band for improved viewing, comprising:

(a) a band, including a curved rigid or semi-rigid portion for engaging an inner side wrist of a wearer, and a flexible portion for engaging the balance of the wearer's wrist;

(b) a watch casing having an upper flat watch face surface and a parallel lower watch surface, the watch face providing a time readout, the watch casing being superposed on the said inner side wrist; and, (c) a mounting integral with the band, for engaging the watch casing, the mounting defining a cavity having an inclined base elevated towards the wearer, and having flexible sidewalls adapted to: i. expand and enable press fitting of the watch casing into the cavity for securing the sides and lower surface of the watch casing into engagement with the corresponding sidewalls and base of the cavity, thereby inclining the watch face surface toward the wearer for improved viewing; and, ii. expand and enable removal of the watch casing from the cavity.

2. The assembly of claim 1, in which the watch casing is elevated about 5°–25° towards viewing of the wearer.

3. The assembly of claim 1, in which the rigid portion of the band is a material selected from the class consisting of: metal, plastic and leather.

4. The assembly of claim 1, in which the watch casing is bonded into the cavity.

5. A wrist watch band providing improved viewing for a watch casing, comprising:

(a) a band, including a curved, rigid or semi-rigid portion for engaging an inner side wrist of a wearer, and a flexible portion for engaging the balance of the wearer's wrist, the band being adapted to engage a watch casing having an upper, flat watch face surface and a parallel lower watch surface, the watch face providing a time readout, the watch casing being superposed on the said inner side wrist; and, (b) a mounting integral with the band for engaging the watch casing, the mounting defining a cavity having an inclined base elevated towards the wearer and having flexible sidewalls adapted to:

i. expand and enable press fitting of the watch casing into the cavity for securing the sides and lower surface of the watch casing into engagement with the corresponding sidewalls and base of the cavity, thereby inclining the watch face surface toward the wearer for improved viewing; and, ii. expand and enable removal of the watch casing from the cavity.

6. The watch band of claim 5, in which the watch casing is elevated about 5°–25° towards the wearer for improved viewing.

7. The watch band of claim 5, in which the rigid portion of the band is a material selected from the class consisting of: metal, plastic and leather.

8. The watch band of claim 5, in which the watch casing is bonded into the cavity.

* * * * *